US005908462A

United States Patent [19]

Batson

[11] Patent Number: 5,908,462

[45] Date of Patent: Jun. 1, 1999

[54] METHOD AND APPARATUS FOR ANTISURGE CONTROL OF TURBOCOMPRESSORS HAVING SURGE LIMIT LINES WITH SMALL SLOPES

[75] Inventor: Brett W. Batson, Dallas Center, Iowa

[73] Assignee: Compressor Controls Corporation, Des Moines, Iowa

[21] Appl. No.: 08/761,124

[22] Filed: Dec. 6, 1996

[51] Int. Cl.[6] ..... G06G 7/70; F04B 49/00

[52] U.S. Cl. ..... 701/100; 701/99; 417/6; 415/1; 415/17; 60/39.07; 60/39.03

[58] Field of Search ..... 700/100, 99; 415/1, 415/17, 39; 702/130, 142; 364/528.17; 60/39.07, 39.05, 39.54, 39.55, 39.29; 417/20, 26, 28, 2, 3, 4, 5, 18, 19, 6

[56] References Cited

U.S. PATENT DOCUMENTS

| | | | |
|---|---|---|---|
| 4,142,838 | 3/1979 | Staroselsky | 417/20 |
| 4,164,033 | 8/1979 | Glennon et al. | 701/100 |
| 4,949,276 | 8/1990 | Staroselsky et al. | 701/100 |
| 4,989,403 | 2/1991 | Rodgers | 60/39.07 |
| 5,195,875 | 3/1993 | Gaston | 417/282 |
| 5,306,116 | 4/1994 | Gunn et al. | 701/100 |
| 5,313,779 | 5/1994 | Rodgers | 60/39.07 |
| 5,347,467 | 9/1994 | Staroselsky et al. | 701/100 |
| 5,508,943 | 4/1996 | Batson et al. | 701/100 |
| 5,526,645 | 6/1996 | Kaiser | 60/611 |
| 5,599,161 | 2/1997 | Batson | 415/17 |
| 5,699,267 | 12/1997 | Batson et al. | 364/528.28 |
| 5,709,526 | 1/1998 | McLeister et al. | 701/100 |
| 5,726,891 | 3/1998 | Sisson et al. | 701/100 |
| 5,743,715 | 4/1998 | Staroselsky | 417/6 |
| 5,752,378 | 5/1998 | Mirsky et al. | 60/39.03 |

OTHER PUBLICATIONS

Copy–16 pages–Brochure Invariant Coordinate Systems For Compressor Control by Dr. B.W. Batson (1996) Jun., 1996.

Copy–of pages from Series 3 Antisurge Controller Instruction Manual IM31 dated Oct., 1990 pages are Nos. Appendix B:fA Modes, Mode 42 (2 pages); p. 22 and p. 23.

*Primary Examiner*—Jacques H. Louis-Jacques
*Attorney, Agent, or Firm*—Henderson & Sturm

[57] ABSTRACT

A turbocompressor's Surge Limit Line, displayed in coordinates of reduced flow rate ($q_r$) and reduced head ($h_r$), can be difficult to characterize if the slope of the line is small; that is, nearly horizontal. And it can be especially difficult to characterize if the surge line exhibits a local maximum or minimum, or both. This is often the case with axial compressors having adjustable inlet guide vanes, and for centrifugal compressors with variable inlet guide vanes and diffuser vanes. With their prime objective being the prevention of surge-induced compressor damage and process upsets, antisurge control algorithms should compensate for variations in suction conditions by calculating both the operating point and the Surge Limit Line, utilizing specific (invariant) coordinates derived by using the notations of similitude or dimensional analysis. The result is that the surge limit is invariant (stationary) to suction conditions. This disclosure describes a new method of antisurge control for turbocompressors, which uses combinations of invariant coordinates that differ from those revealed in the prior art. Subsequently, the key to this invention is that any combination (linear or nonlinear) of invariant coordinates is also invariant.

44 Claims, 11 Drawing Sheets

METHOD AND APPARATUS FOR ANTISURGE CONTROL OF TURBOCOMPRESSORS HAVING SURGE LIMIT LINES WITH SMALL SLOPES

TECHNICAL FIELD

This invention relates generally to a control method and apparatus for antisurge control of turbocompressors having Surge Limit Lines with small slopes. More particularly, it relates to a method which determines a surge line and an operating point (both associated with a turbocompressor) by using specific combinations of invariant coordinates.

BACKGROUND ART

A turbocompressor's Surge Limit Line, displayed in coordinates of volumetric flow rate ($Q_s$) and polytropic head ($H_p$), can be difficult to characterize if the slope of the line is small; that is, nearly horizontal. And it can be especially difficult to characterize if the surge line exhibits a local maximum or minimum, or both. This is often the case with axial compressors having adjustable inlet guide vanes, and for centrifugal compressors with both variable inlet guide vanes and diffuser vanes.

The present-day method of transforming a Surge Limit Line to common invariant spaces, such as reduced flow rate and pressure ratio ($q_r^2$, $R_c$) or reduced flow rate and reduced head ($q_r^2$,$h_r$), does not diminish the characterizing problem.

Surge Limit Lines exhibiting local maxima and minima are not functions of pressure ratio or of reduced head since the relationship is not one-to-one for either surge line. For this reason, it is impossible to accurately describe them (even for constant equivalent speed) using the standard approach to construct an antisurge parameter, $S_s=f(R_c)/q_r^2$.

SUMMARY OF THE INVENTION

The purpose of this invention is to provide antisurge control for turbocompressors having Surge Limit Lines with small slopes (nearly horizontal). This proposed control method will easily and accurately determine a surge limit and an operating point (both associated with a turbocompressor) by using combinations of invariant coordinates that differ from those revealed in the prior art. The emphasis of this new technique is directed to axial compressors having adjustable inlet guide vanes, and to centrifugal compressors with both variable inlet guide vanes and diffuser vanes; although the method has application with many types of turbocompressors.

Turbocompressor antisurge control algorithms should compensate for variations in suction conditions; this is accomplished by calculating the operating point and the Surge Limit Line, utilizing specific coordinates referred to as invariant coordinates which are derived by using the notations of similitude or dimensional analysis. The result is that the surge limit is invariant (stationary) to suction conditions. Subsequently, the key to this invention is that any combination (linear or nonlinear) of invariant coordinates is also invariant; and the invariant coordinates of interest are:

$$\text{Pressure ratio: } R_c = \frac{p_d}{p_s}$$

$$\text{Reduced head: } h_r = \frac{R_c^{\sigma} - 1}{\sigma}$$

-continued $$\text{Reduced flow rate: } q_r = \sqrt{\frac{\Delta p_o}{p}}$$

$$\text{Equivalent speed: } N_e = \frac{N}{\sqrt{ZRT}}$$

where:

$p_d$=absolute pressure at discharge $p_s$=absolute pressure in suction $$\sigma = \frac{\log[(ZT)_d/(ZT)_s]}{\log R_c}$$

$\Delta p_o$=differential pressure flow measurement (in suction or discharge)

p=pressure

N=rotational speed

Z=compressibility

R=gas constant

T=temperature

The derivation of the above invariant coordinates is introduced on pages 3–8 of ASME technical publication (96-GT-240) by Batson entitled, "Invariant Coordinate Systems for Compressor Control," which is incorporated herein by reference. Furthermore, information pertaining to invariant coordinates, applicable to this invention, is described in U.S. Pat. No. 5,508,943 by Batson and Narayanan entitled, "Method and Apparatus for Measuring the Distance of a Turbocompressor's Operating Point to the Surge Limit Interface," most particularly relative to the specification therein, which patent is incorporated herein by reference.

BEST MODE FOR CARRYING OUT THE INVENTION

The task of characterizing a Surge Limit Line, displayed in volumetric flow rate ($Q_s$) and polytropic head ($H_p$), can be difficult or even impossible if the slope of this line is nearly horizontal. Transforming this surge limit to the commonly used invariant spaces ($q_r^2$,$R_c$) or ($q_r^2$,$h_r$) does not reduce the problem. This situation is not unusual with variable geometry compressors, such as axial compressors having adjustable inlet guide vanes, and centrifugal compressors with both variable inlet guide vanes and diffuser vanes. The characterizing task is even more difficult if the Surge Limit Lines exhibit a local maximum or minimum, or both.

In the coordinates ($q_r^2$,$R_c$) or ($q_r^2$,$h_r$), the surge limit for variable geometry compressors is fixed for a constant equivalent speed ($N_e$). In other words, the surge limit is a surface that is intersected with a plane of constant $N_e$ to reduce it to a single curve—valid only for that value of $N_e$.

Figure 1:
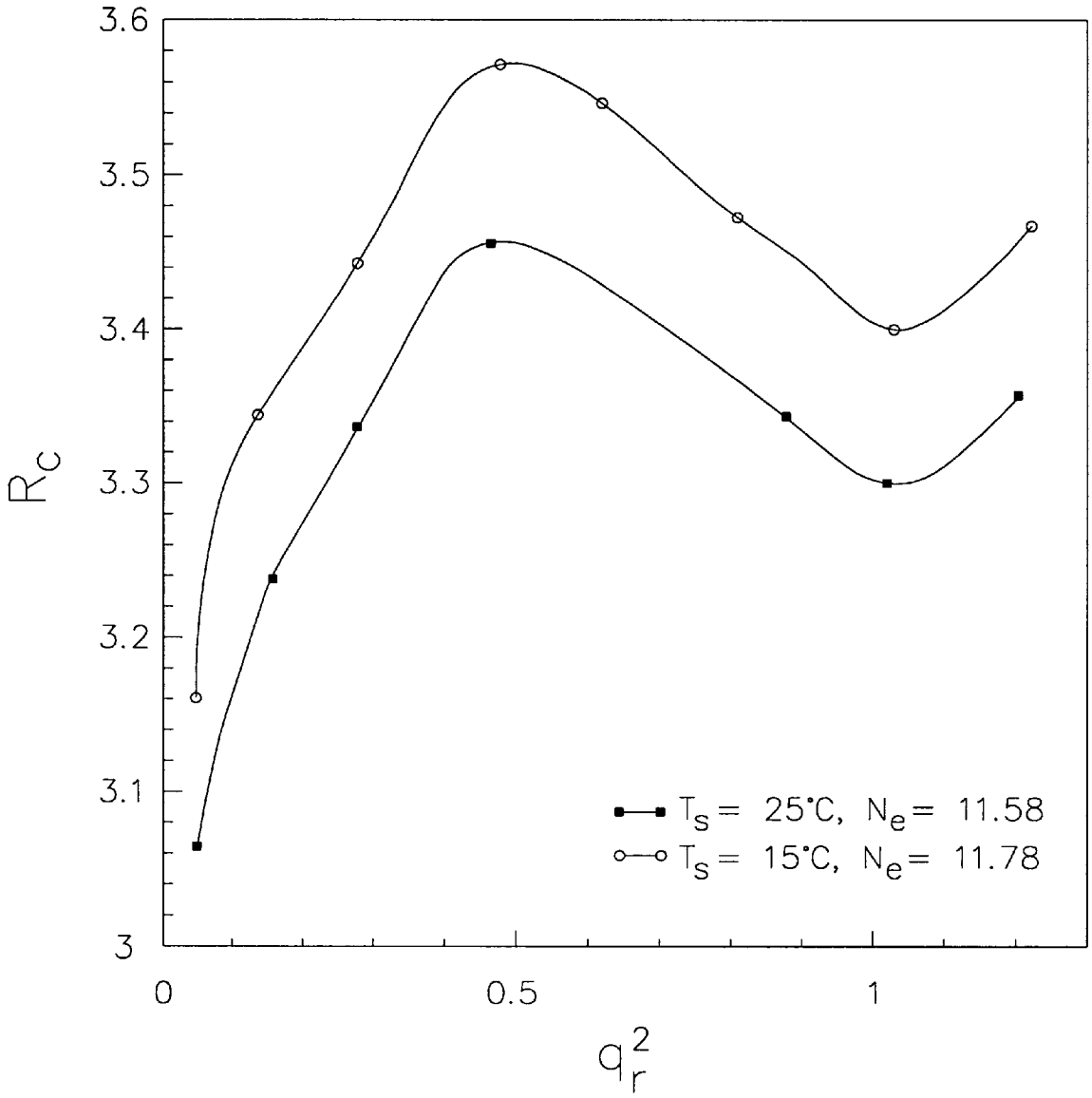
FIG. 1 shows a compressor map in the invariant space ($q_r^2$,$R_c$) with Surge Limit Lines exhibiting a local maximum and minimum.

FIG. 1 is an example of a compressor map with Surge Limit Lines exhibiting a local maximum and minimum in the invariant space ($q_r^2$,$R_c$). In the construction of this figure, speed and molecular weight were constant, only the temperature caused the equivalent speed to vary. These surge lines are not functions of $R_c$ since the relationship is not one-to-one. For this reason, it is impossible to accurately describe the lines (even for constant $N_e$) by using the standard approach to construct an antisurge parameter:

$$S_s = \frac{f(R_c)}{q_r^2}$$

Figure 2:
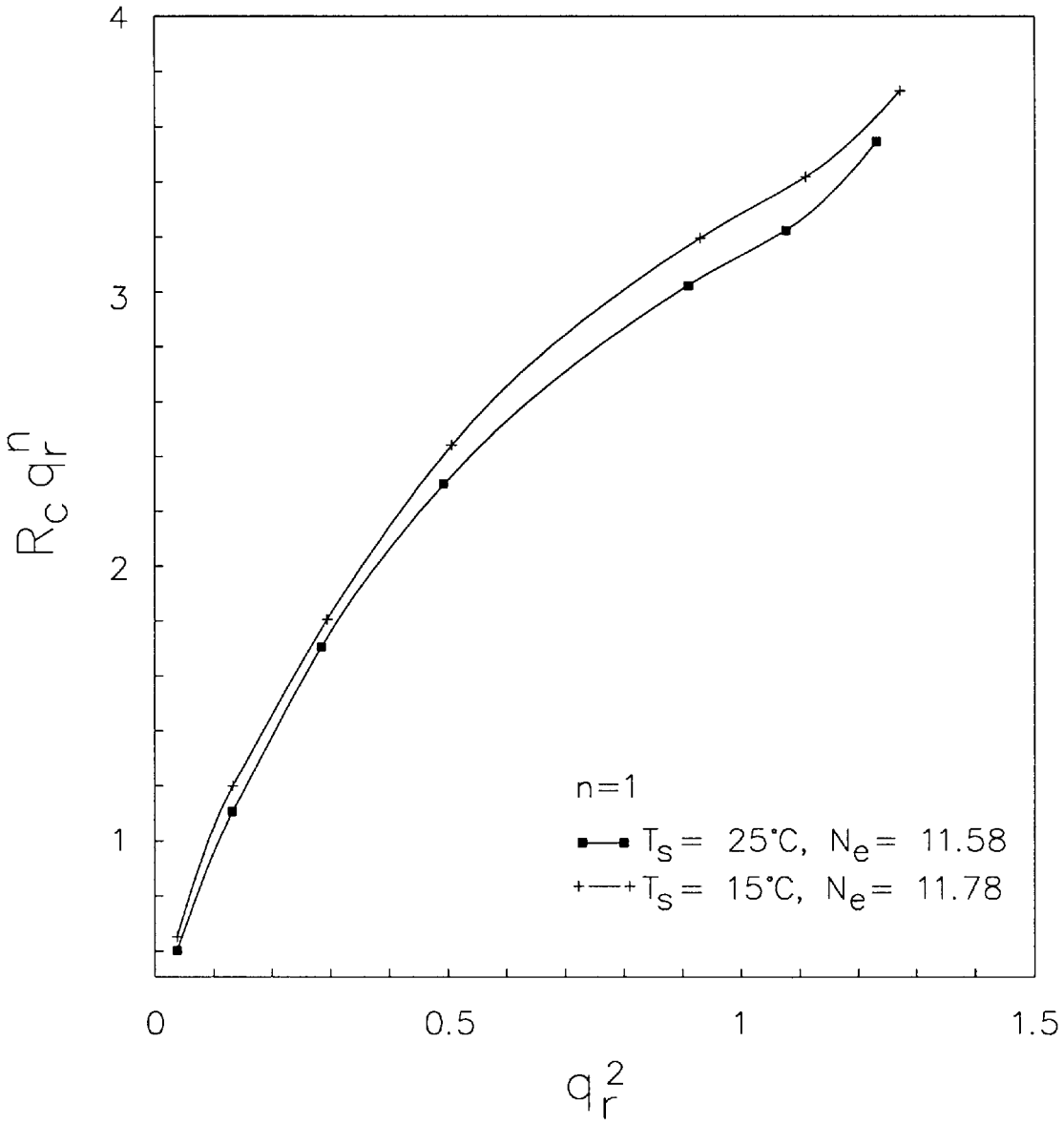
FIG. 2 shows a compressor map in the transformed space ($q_r^2$,$R_c q_r^n$).

As mentioned in Disclosure of the Invention, any combination (linear or nonlinear) of invariant coordinates is also invariant. Therefore, the characterizing problem stated above is easily remedied by utilizing the combinations $R_c q_r^n$ and $h_r q_r^n$ where n is real ($n \in R$). Results of the transformation of the Surge Limit Lines of FIG. 1 are now depicted in FIG. 2 which shows the lines at different temperatures. Over most of their range, the slope of these new curves is significantly greater than those in ($q_r^2$,$R_c$) space. Moreover, the slope is, everywhere, nonnegative. FIG. 2 also shows that the surge limit interface is a surface in the coordinates ($q_r^2$,$q_r^n R_c^m$,$N_e$) where, in this figure, n=m=1. Therefore, a parameter indicating proximity to surge could be constructed as $$S_s = \frac{f_1(q_r^n R_c^m, N_e)}{q_r^2} \tag{1}$$

where the function $f_1(\cdot)$ returns the value of $q_r^2$ at surge.

Figure 3:
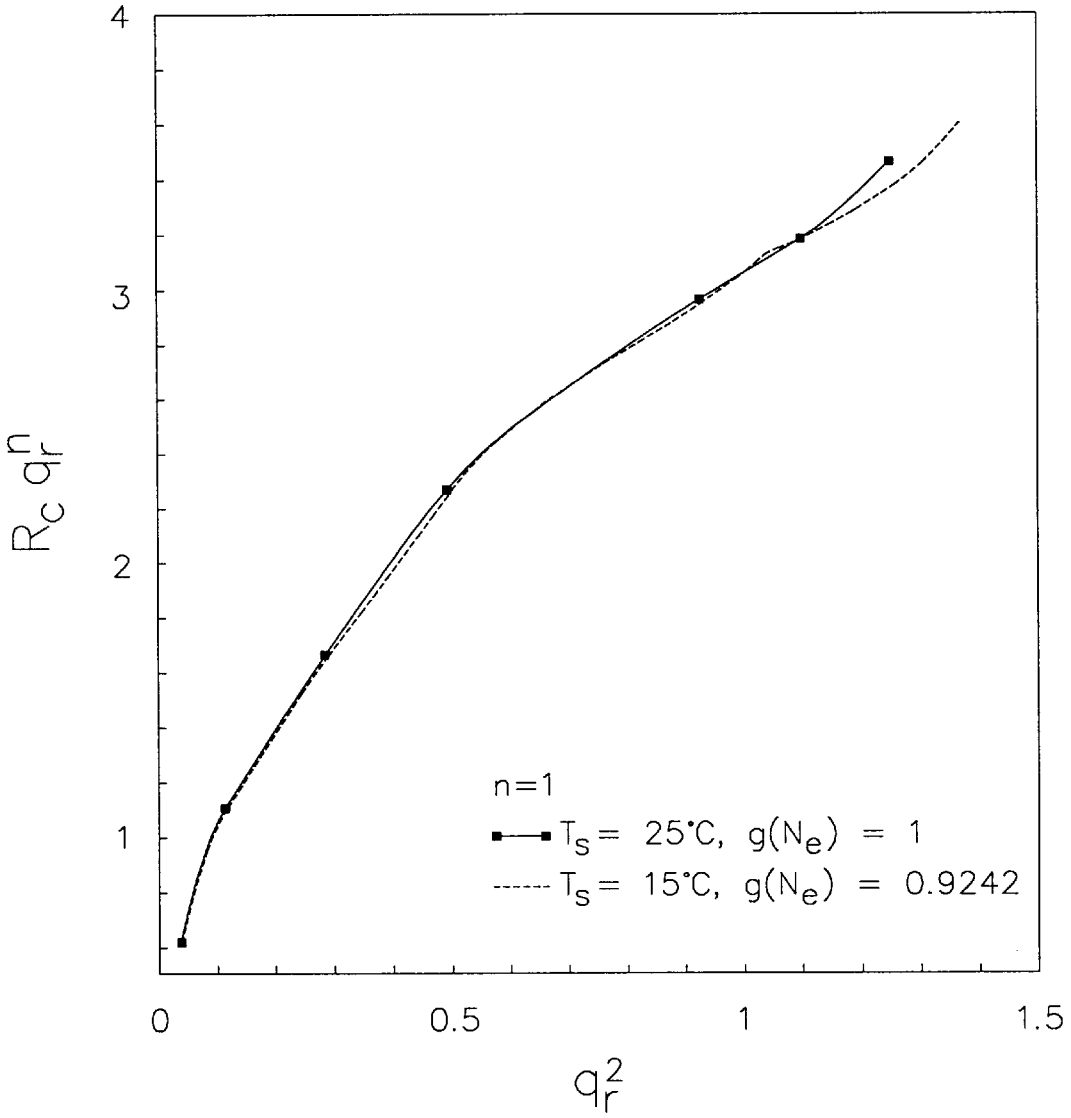
FIG. 3 shows a compressor map in the transformed space ($q_r^2$,$R_c q_r^n$,$N_e$).

FIG. 3 shows how the function in the numerator of Eq. (1) can be separated into two, such as $$S_s = \frac{f(q_r^n R_c^m)}{q_r^2} g(N_e) \tag{2}$$

where the product of the functions $f(\cdot)$ and $g(\cdot)$ returns the value of $q_r^2$ at surge.

The form of the proximity to the surge variable defined by Eq. (2) is easier to commission than that of Eq. (1). Each of the functions $f(q_r^n R_c^m)$ and $g(N_e)$ can be determined separately. In both FIG. 2 and FIG. 3, similar results would be realized if reduced head ($h_r$) were used rather than pressure ratio ($R_c$).

More generally, functions defined as $R_c^m q_r^n$ and $h_r^{\alpha} q_r^{\beta}$ (where m, n, α, and β are real-valued exponents) are useful for these cases. Usually, m and n, or α and β will not be unique for a given Surge Limit Line, but are chosen to (1) eliminate regions of negative slope, and (2) provide for simple and accurate characterization as a function of $N_e$.

Figure 4A:
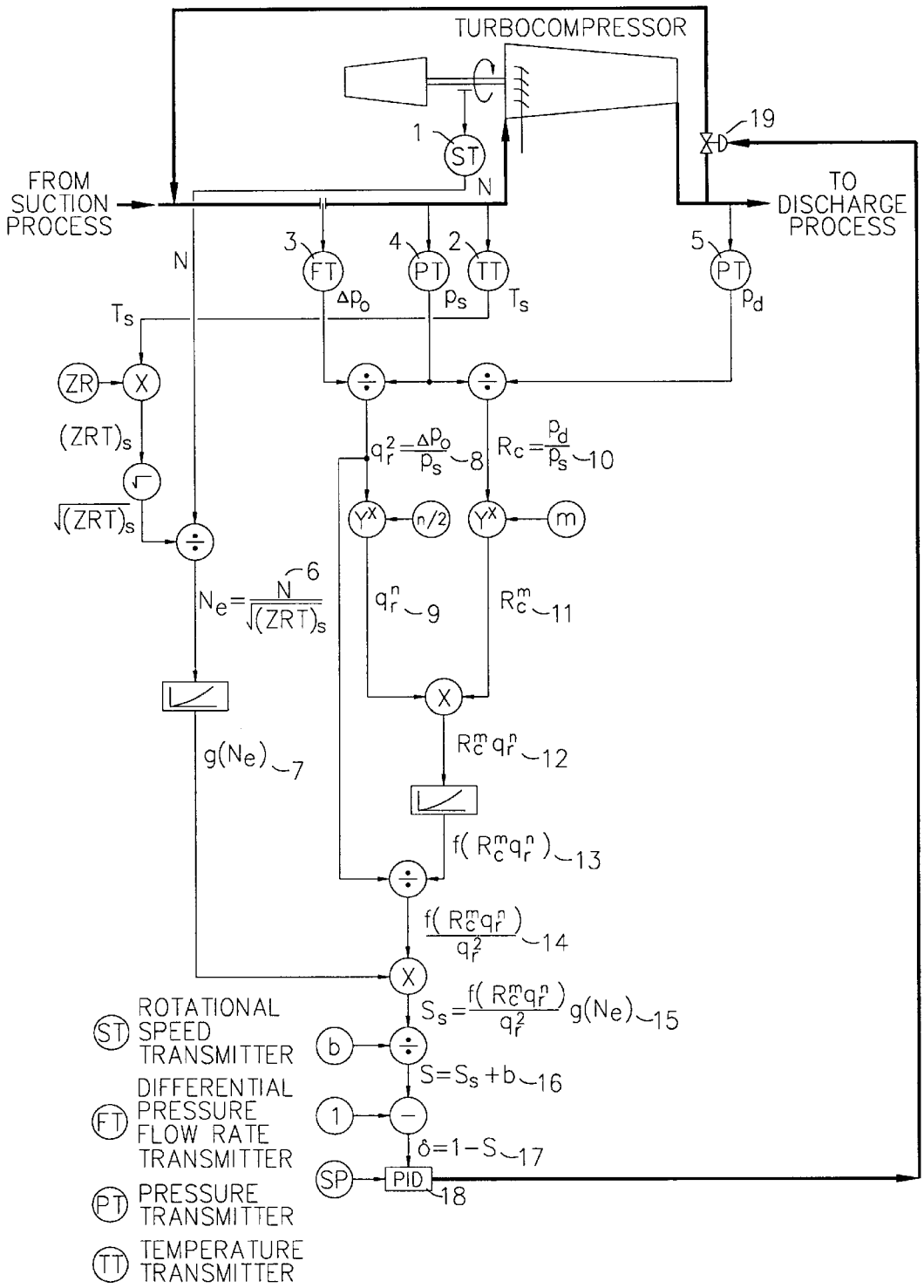
FIG. 4A shows a schematic diagram of a turbocompressor and its control scheme for calculating a quantity (invariant coordinate), $R_c^m q_r^n$, using $p_s$ for the calculation of $q_r^2$.

FIG. 4A shows a schematic diagram of a turbocompressor installation and its control scheme for determining a surge line and an operating point as functions of a quantity (invariant coordinate), $R_c^m q_r^n$. The installation incorporates transmitters for detecting and generating a rotational speed signal (N) 1 and a suction temperature signal ($T_s$) 2. Also included are devices for detecting and generating process input signals, such as differential pressure ($\Delta p_o$) 3 across a differential flow measurement device, suction pressure ($p_s$) 4, and discharge pressure ($p_d$) 5.

In the block-diagram portion of FIG. 4A, speed and suction temperature transmitter data (N and $T_s$) 1, 2 are acted on by algebraic operations to produce an equivalent speed value ($N_e$) 6 which is then characterized as a function, $g(N_e)$ 7. Concurrently, a module calculates a reduced flow rate ($q_r^2$) 8 by dividing the differential pressure signal by the suction pressure signal. Following that, the quotient ($q_r^2$) is taken to the n/2 power as a reduced flow parameter ($q_r^n$) 9. Another module calculates a pressure ratio ($R_c$) 10 which is taken to the m power as a pressure ratio parameter ($R_c^m$) 1, then multiplied by $q_r^n$ to yield the product $R_c^m q_r^n$ 12, and characterized as a function, $f(R_c^m q_r^n)$ 13. At this time, a divider calculates a ratio 14

$$\frac{f(R_c^m q_r^n)}{q_r^2}$$

that is multiplied by $g(N_e)$, resulting in a modified antisurge parameter 15

$$S_s = \frac{f(R_c^m q_r^n)}{q_r^2} g(N_e)$$

Note that this modified antisurge parameter equation differs from the standard approach version by the inclusion of the modification factor $g(N_e)$, and of the reduced flow parameter ($q_r^n$) in the dividend: $f(R_c^m q_r^n)$ versus $f(R_c)$.

The modified antisurge parameter ($S_s$) is summed with a safety margin (b) to construct a surge control line ($S=S_s+b$) 16. The value S is then processed by a subtracter to define the distance between an operating point and a surge control line ($\delta=1-S$) 17. Finally, the distance (δ) and a predetermined set point (SP) are both transmitted to a Proportional-Integral-Differential (PID) controller 18 and processed into a signal for modulating an end control element 19.

Figure 4B:
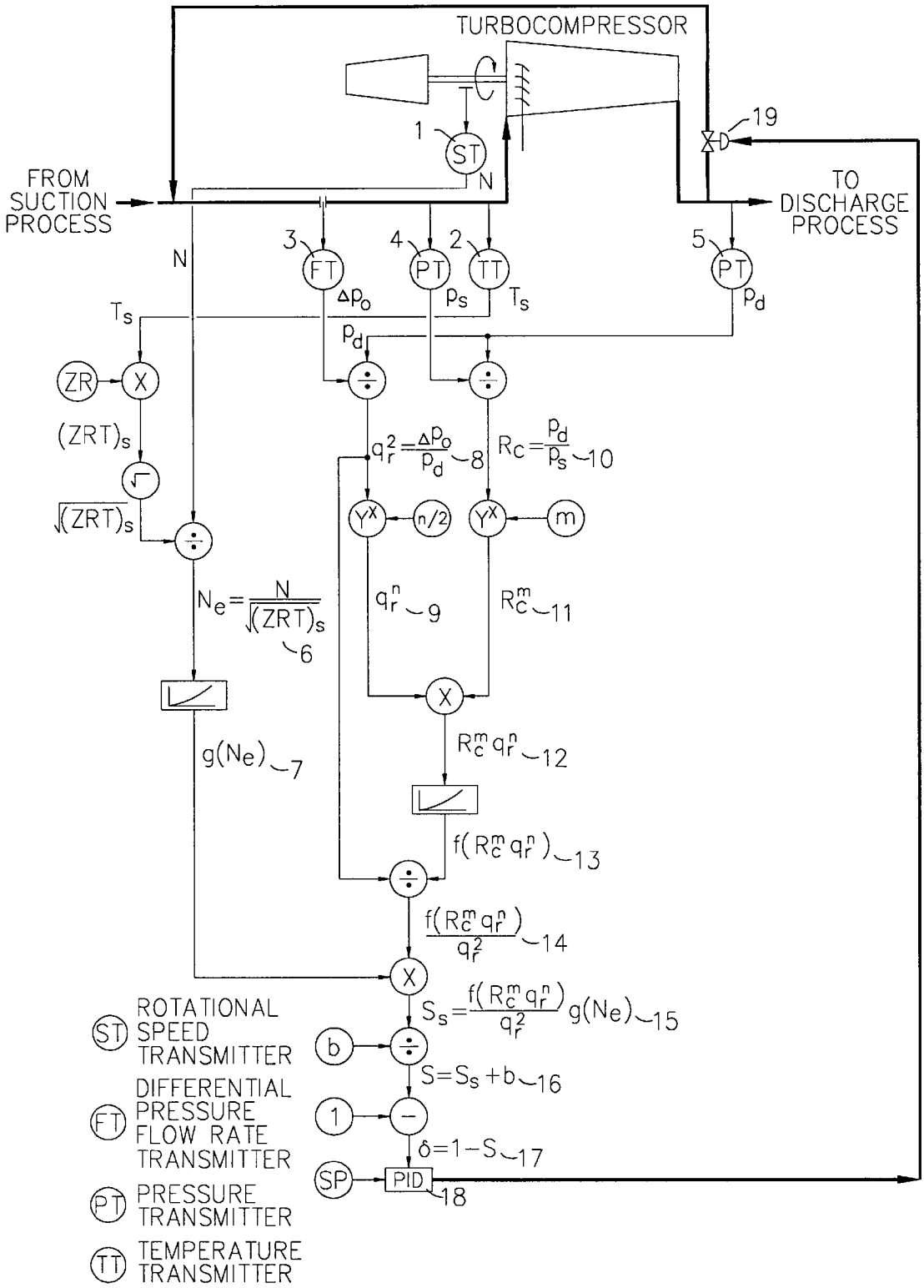
FIG. 4B shows a schematic diagram of a turbocompressor and its control scheme for calculating a quantity (invariant coordinate), $R_c^m q_r^n$, using $p_d$ for the calculation of $q_r^2$.

FIG. 4B shows an identical diagram layout to that of FIG. 4A, but with a discharge pressure signal ($p_d$) as the divisor for calculating a reduced flow rate ($q_r^2$) 8.

Figure 4C:
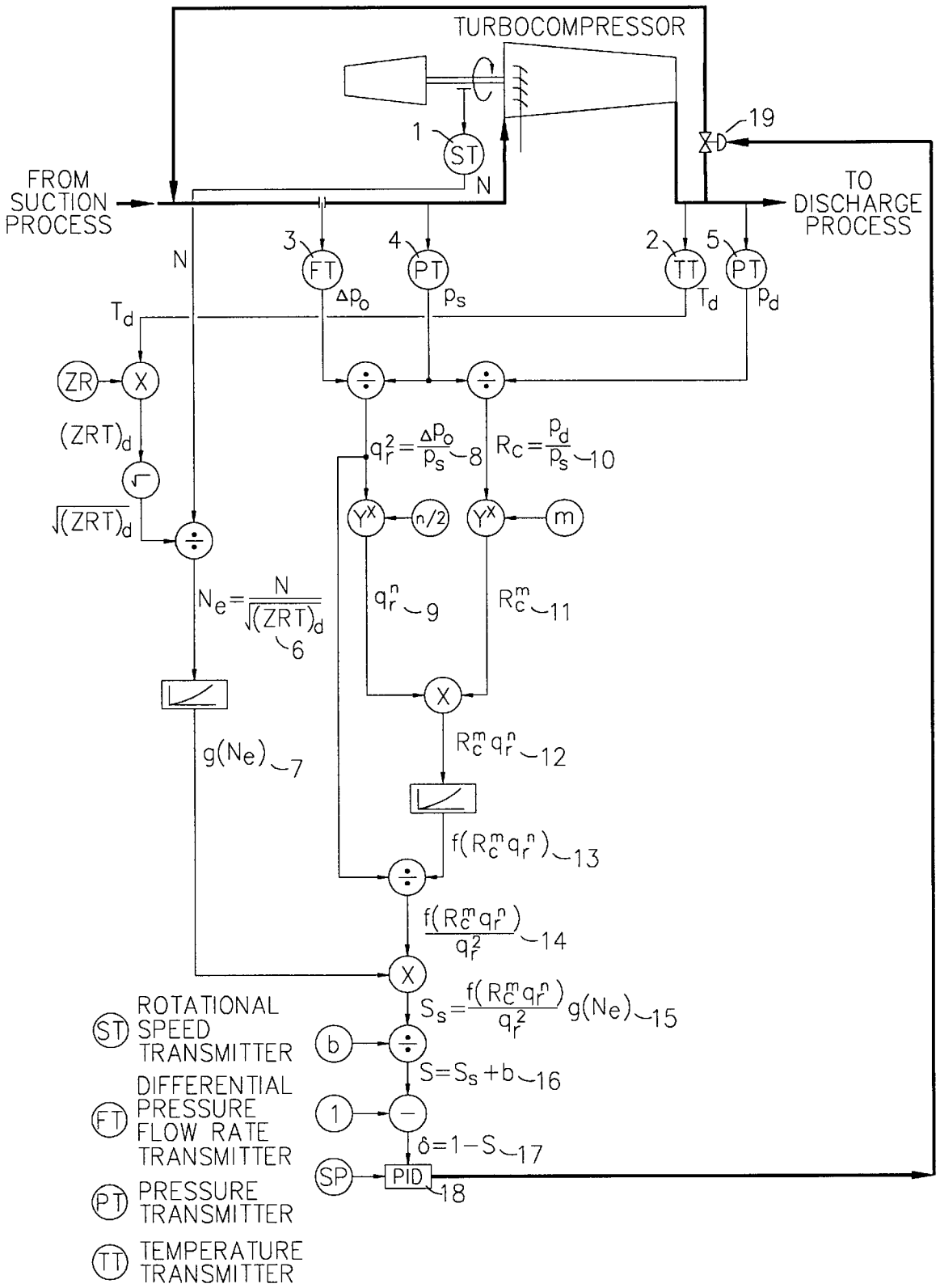
FIG. 4C shows a schematic diagram of a turbocompressor and its control scheme for calculating a quantity (invariant coordinate), $R_c^m q_r^n$, using $T_d$ for the calculation of $N_e$.

FIG. 4C shows an identical diagram layout to that of FIG. 4A, but with discharge temperature data ($T_d$) 2 used to produce an equivalent speed value ($N_e$) 6.

Figure 4D:
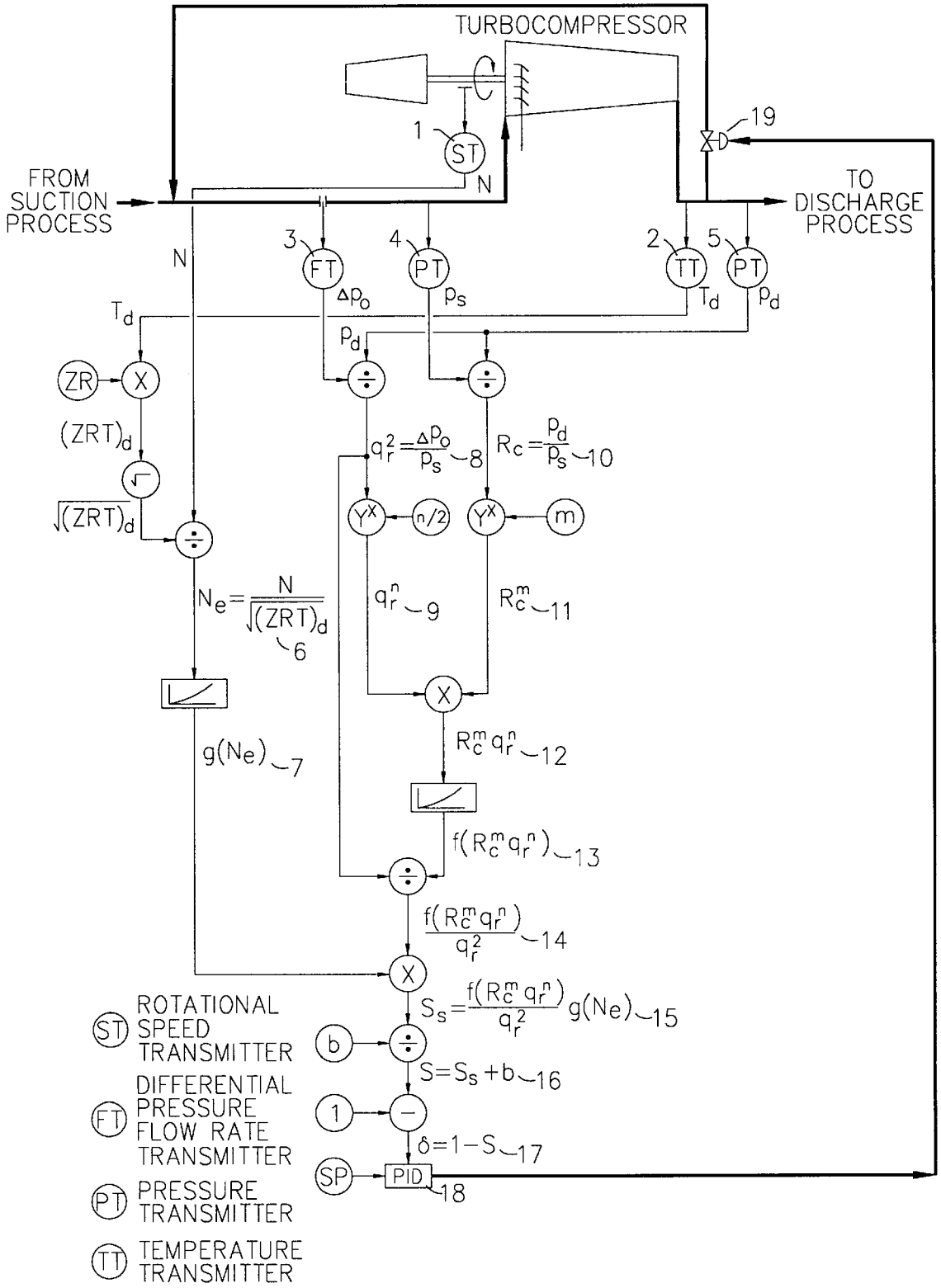
FIG. 4D shows a schematic diagram of a turbocompressor and its control scheme for calculating a quantity (invariant coordinate), $R_c^m q_r^n$, using $T_d$ for the calculation of $N_e$, and $p_d$ for the calculation of $q_r^2$.

FIG. 4D shows an identical diagram layout to that of FIG. 4C, but with a discharge pressure signal ($p_d$) as the divisor for calculating a reduced flow rate ($q_r^2$) 8.

Figure 5A:
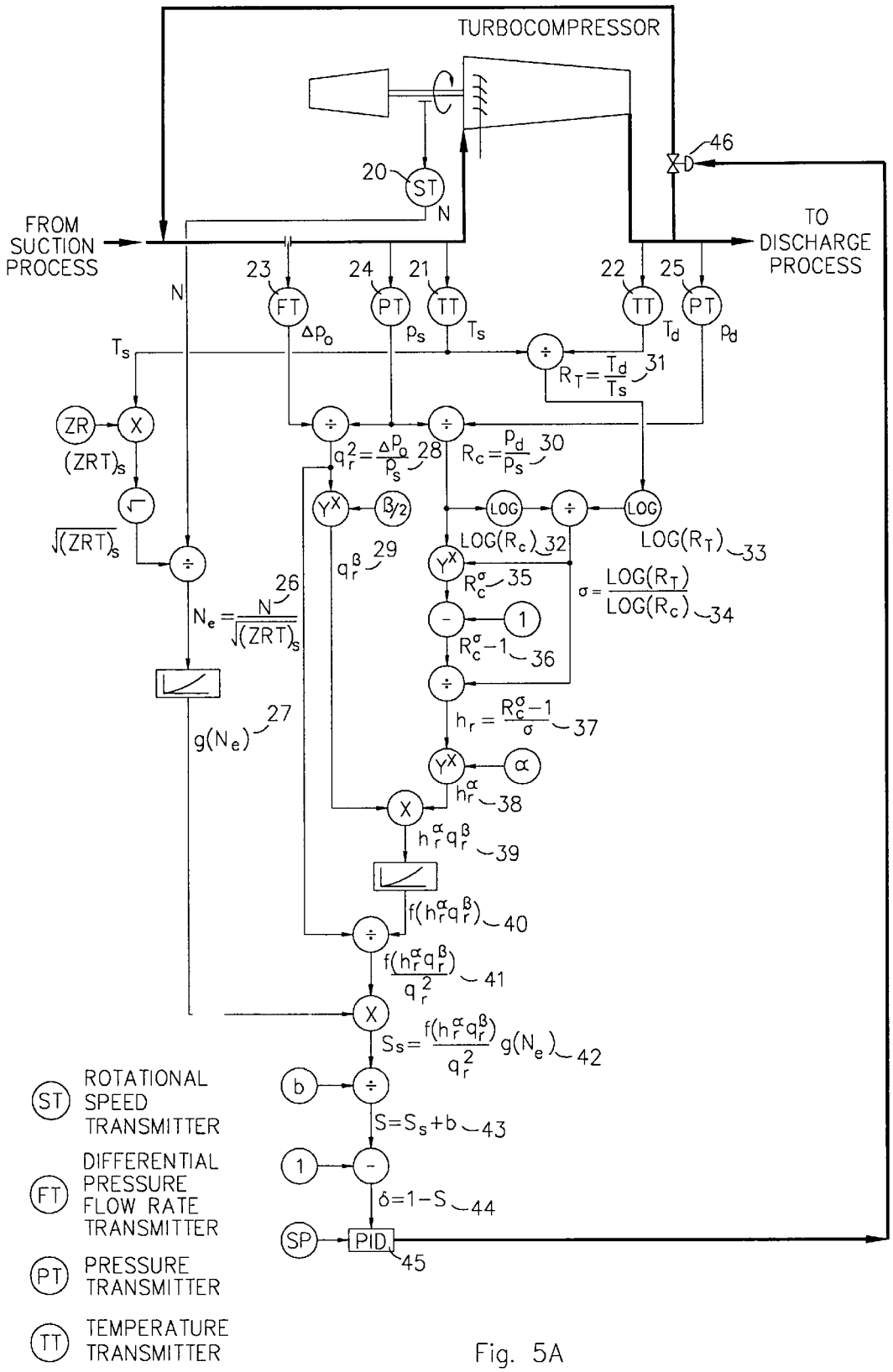
FIG. 5A shows a schematic diagram of a turbocompressor and its control scheme for calculating a quantity (invariant coordinate), $h_r^{\alpha} q_r^{\beta}$, using $p_s$ for the calculation of $q_r^2$.

FIG. 5A shows a schematic diagram of a turbocompressor installation and its control scheme for determining a surge line and an operating point as functions of a quantity (invariant coordinate), $h_r^{\alpha}q_r^{\beta}$. The installation incorporates transmitters for detecting and generating a rotational speed signal (N) 20, a suction temperature signal ($T_s$) 21, and a discharge temperature signal ($T_d$) 22. Also included are devices for detecting and generating process input signals, such as differential pressure ($\Delta p_o$) 23 across a differential flow measurement device, suction pressure ($p_s$) 24, and discharge pressure ($p_d$) 25.

In the block-diagram portion of FIG. 5A, speed and temperature transmitter data (N and $T_s$) 20, 21 are acted on by algebraic operations to produce an equivalent speed value ($N_e$) 26 which is then characterized as a function, $g(N_e)$ 27. Concurrently, a module calculates a reduced flow rate ($q_r^2$) 28 by dividing the differential pressure signal by the suction pressure signal. Following that, the quotient ($q_r^2$) is taken to the $\beta/2$ power to calculate a reduced flow parameter ($q_r^{\beta}$) 29. Another module calculates a pressure ratio ($R_c$) 30, while yet another calculates a temperature ratio ($R_T$) 31. Next, the logarithms of both the pressure ratio [$\log(R_c)$] 32 and the temperature ratio [$\log(R_T)$] 33 are computed and jointly acted on by a divider to calculate an exponent ($\sigma$) 34.

The pressure ratio ($R_c$) is taken to the $\sigma$ power 35, reduced by unity ($R_c^{\sigma}-1$) 36, and divided by the exponent ($\sigma$) to calculate a reduced head ($h_r$) 37. Following that, reduced head is taken to the $\alpha$ power as a reduced head parameter ($h_r^{\alpha}$) 38, then multiplied by $q_r^{\beta}$ to yield the product $h_r^{\alpha}q_r^{\beta}$ 39, and characterized as a function, $f(h_r^{\alpha}q_r^{\beta})$ 40. At this time, a divider calculates a ratio 41

$$\frac{f(h_r^{\alpha}q_r^{\beta})}{q_r^2}$$

that is multiplied by $g(N_e)$, resulting in a modified antisurge parameter 42

$$S_s = \frac{f(h_r^{\alpha}q_r^{\beta})}{q_r^2}g(N_e)$$

Note that this modified parameter equation differs from the standard approach version by the inclusion of the modification factor $g(N_e)$, and of the invariant coordinate ($h_r^{\alpha}q_r^{\beta}$) in the dividend: $f(h_r^{\alpha}q_r^{\beta})$ versus $f(R_c)$.

The modified surge parameter ($S_s$) is summed with a safety margin (b) to construct a surge control line ($S=S_s+b$) 43. The value S is then processed by a subtracter to define the distance between an operating point and a surge control line ($\delta=1-S$) 44. Finally, the distance ($\delta$) and a predetermined set point (SP) are both transmitted to a PID controller 45 and processed into a signal for modulating an end control element 46.

Figure 5B:
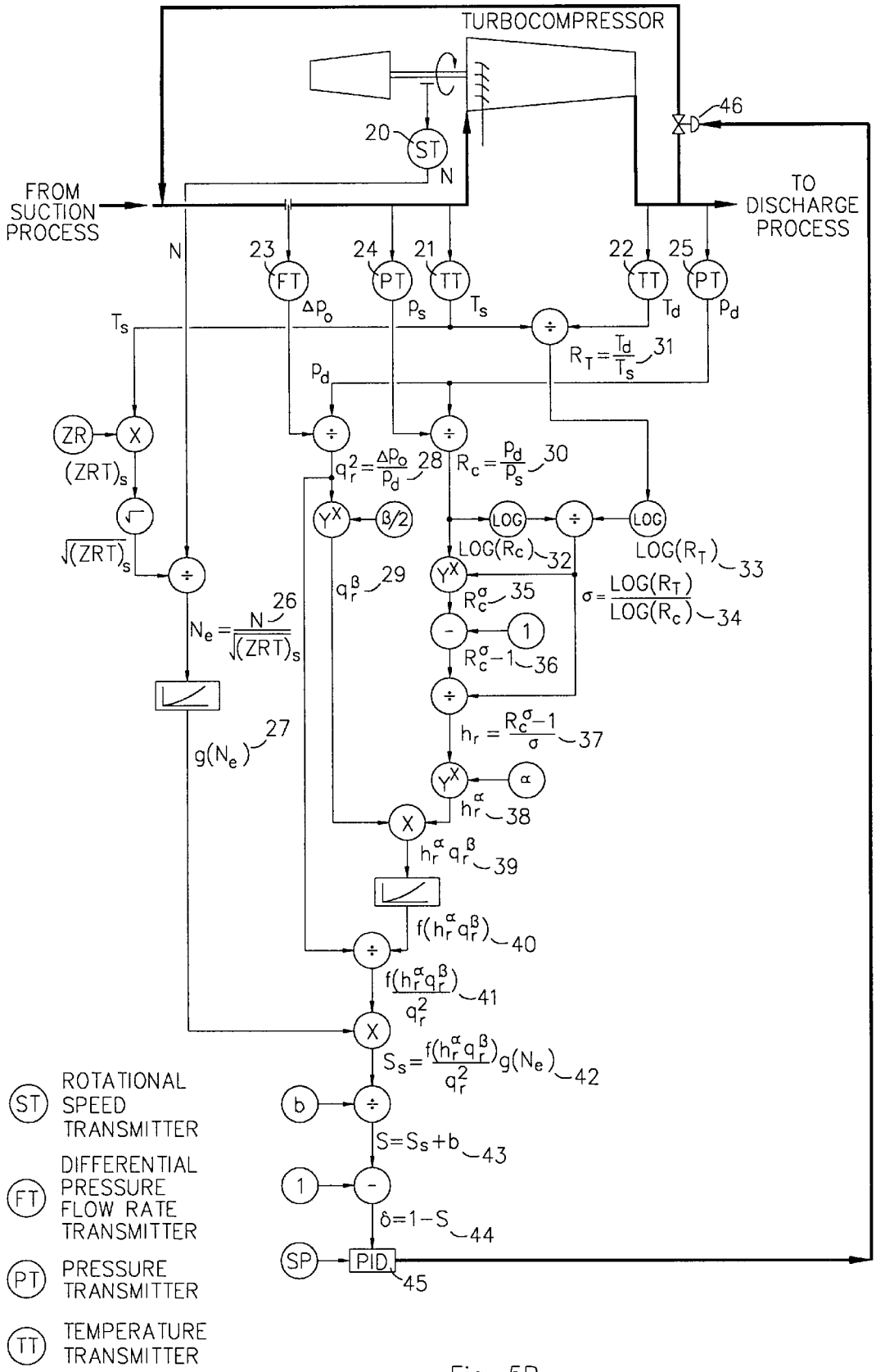
FIG. 5B shows a schematic diagram of a turbocompressor and its control scheme for calculating a quantity (invariant coordinate), $h_r^{\alpha} q_r^{\beta}$, using $p_d$ for the calculation of $q_r^2$.

FIG. 5B shows an identical diagram layout to that of FIG. 5A, but with a discharge pressure signal ($p_d$) as the divisor for calculating a reduced flow rate ($q_r^2$) 28.

Figure 5C:
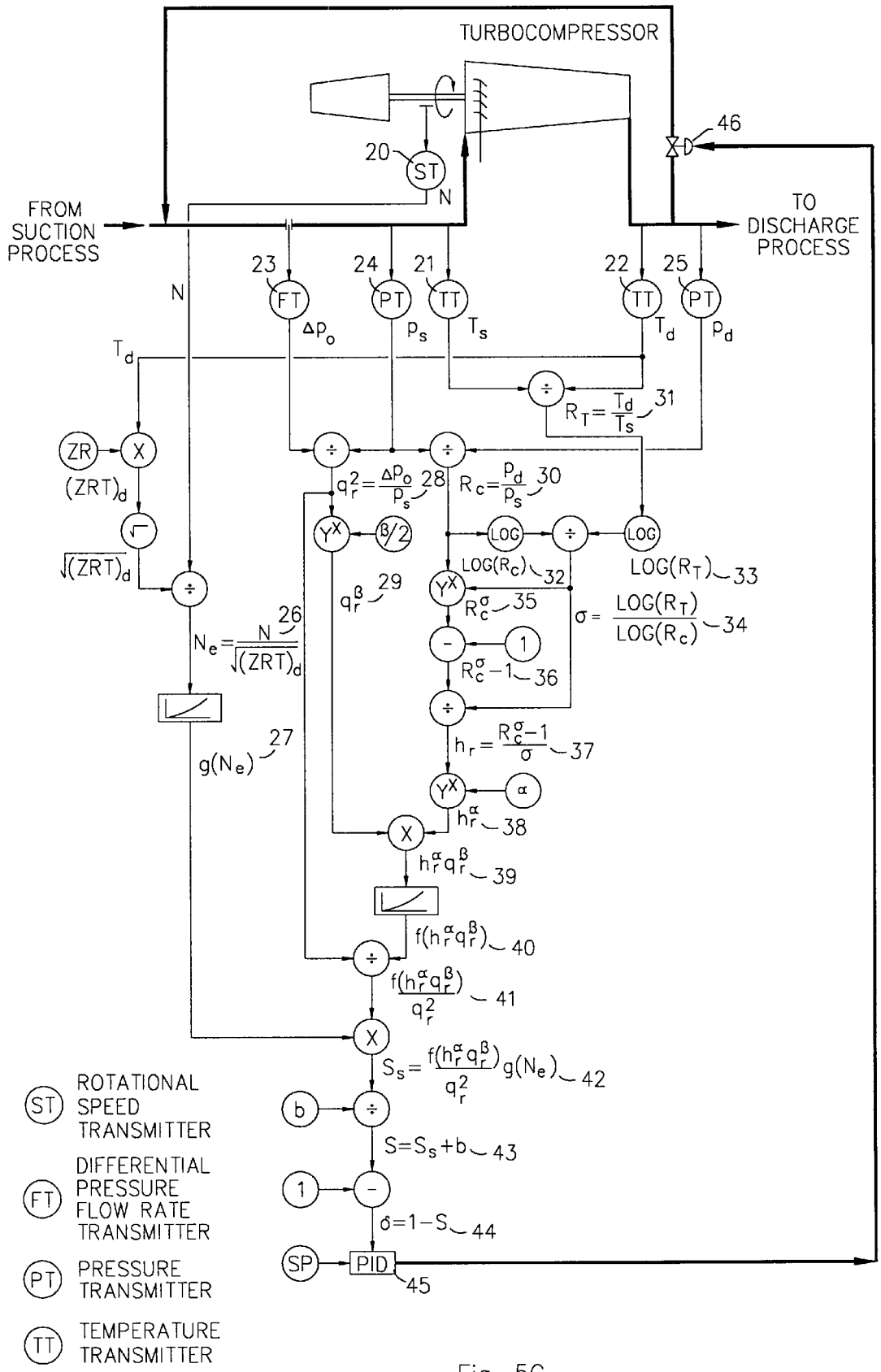
FIG. 5C shows a schematic diagram of a turbocompressor and its control scheme for calculating a quantity (invariant coordinate), $h_r^{\alpha} q_r^{\beta}$, using $T_d$ for the calculation of $N_e$.

FIG. 5C shows an identical diagram layout to that of FIG. 5A, but with discharge temperature data ($T_d$) 22 used to produce an equivalent speed value ($N_e$) 26.

Figure 5D:
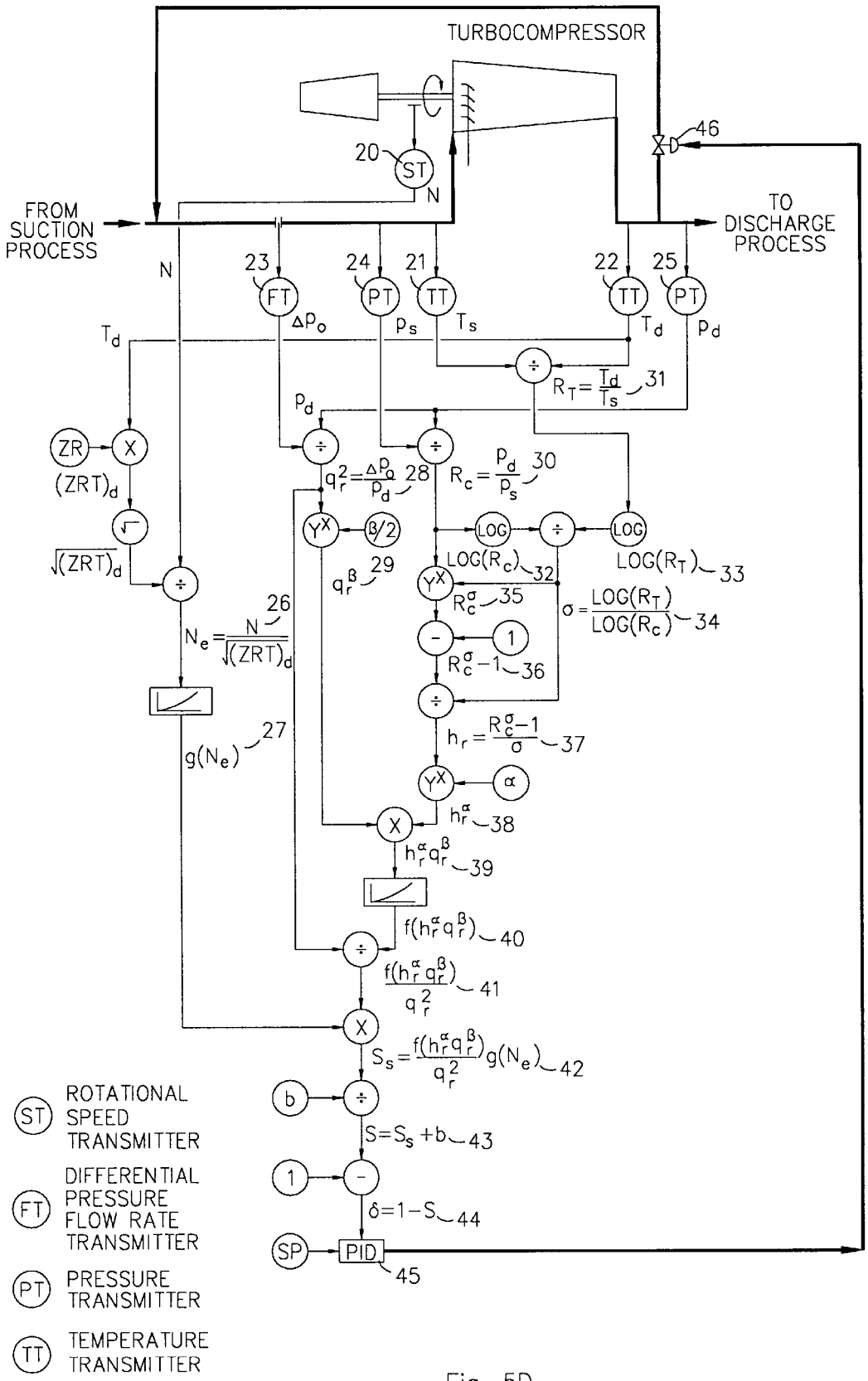
FIG. 5D shows a schematic diagram of a turbocompressor and its control scheme for calculating a quantity (invariant coordinate), $h_r^{\alpha}q_r^{\beta}$, using $T_d$ for the calculation of $N_e$, and $p_d$ for the calculation of $q_r^2$.

FIG. 5D shows an identical diagram layout to that of FIG. 5C, but with a discharge pressure signal ($p_d$) as the divisor for calculating a reduced flow rate ($q_r^2$) 28.

In all turbocompressor installation schematics (FIGS. 4A–D and 5A–D), the flow measurement device, FT, can be located in either the suction or the discharge of the compressor.

This new technique has been described as being applicable to axial compressors having adjustable inlet guide vanes, and to centrifugal compressors with both variable inlet guide vanes and diffuser vanes; however the method has application with many types of turbocompressors not of the aforementioned types.

Obviously, many modifications and variations of the present inventions are possible in light of the above teachings. It is, therefore, to be understood that within the scope of the appended claims, the invention may be practiced otherwise than as specifically described.

I claim:

1. A method of protecting a turbocompressor from surge, the method comprising the steps of:

(a) determining a surge line associated with the turbocompressor as a function of a quantity, $R_c^m q_r^n$;

(b) determining an operating point of the turbocompressor as a function of the quantity $R_c^m q_r^n$;

(c) comparing the turbocompressor's operating point to the surge line; and (d) modulating an end control element associated with the turbocompressor, based on the comparison, to protect the turbocompressor from surge.

2. The method of claim 1 wherein m and n are real-valued exponents.

3. The method of claim 1 wherein the surge line is also determined as a function of $q_r$.

4. The method of claim 1 wherein the operating point is also determined as a function of $q_r$.

5. The method of claim 1 wherein the surge line is also determined as a function of $N_e$.

6. The method of claim 1 wherein the operating point is also determined as a function of $N_e$.

7. The method of claim 1 wherein the step of comparing the turbocompressor's operating point to the surge line comprises the steps of:

(a) defining a set point value a predetermined distance from the surge line; and (b) comparing the set point value to the operating point.

8. The method of claim 7 wherein the predetermined distance is variable during operation.

9. The method of claim 7 wherein the step of defining a set point value comprises the steps of:

(a) plotting the surge line as a function of $R_c^m q_r^n$ versus $q_r^2$;

(b) defining a set point reference line at a particular value of $R_c^m q_r^n$; and (c) selecting the set point on the set point reference line.

10. The method of claim 1 wherein the step of determining an operating point as a function of the quantity $R_c^m q_r^n$ comprises the steps of:

(a) detecting a differential pressure, $\Delta p_o$, produced by a differential pressure flow measurement device, and generating a differential pressure signal proportional to the differential pressure flow measurement;

(b) detecting a suction pressure, $p_s$, produced by a pressure measurement device in a suction of the turbocompressor, and generating a suction pressure signal proportional to the suction pressure;

(c) detecting a discharge pressure, $p_d$, produced by a pressure measurement device in a discharge of the turbocompressor, and generating a discharge pressure signal proportional to the discharge pressure;

(d) calculating a pressure ratio parameter, $R_c^m$, by dividing the discharge pressure signal by the suction pressure signal, and taking the quotient to the m power;

(e) calculating a reduced flow parameter, $q_r^n$, by dividing the differential pressure signal by one of the suction pressure or discharge pressure signals, and taking the quotient to the n/2 power; and (f) calculating a product by multiplying the pressure ratio parameter by the reduced flow parameter.

11. The method of claim 1 wherein the step of determining a surge line as a function of a quantity, $R_c^m q_r^n$, comprises the steps of:

(a) detecting a differential pressure, $\Delta p_o$, produced by a differential pressure flow measurement device, and generating a differential pressure signal proportional to the differential pressure flow measurement;

(b) detecting a suction pressure, $p_s$, produced by a pressure measurement device in a suction of the turbocompressor, and generating a suction pressure signal proportional to the suction pressure;

(c) detecting a discharge pressure, $p_d$, produced by a pressure measurement device in a discharge of the turbocompressor, and generating a discharge pressure signal proportional to the discharge pressure;

(d) calculating a pressure ratio parameter, $R_c^m$, by dividing the discharge pressure signal by the suction pressure signal, and taking the quotient to the m power;

(e) calculating a reduced flow parameter, $q_r^n$, by dividing the differential pressure signal by one of the suction pressure or discharge pressure signals, and taking the quotient to the n/2 power;

(f) calculating a product by multiplying the pressure ratio parameter by the reduced flow parameter; and (g) evaluating a function of the product $f(R_c^m q_r^n)$.

12. A method of protecting a turbocompressor from surge, the method comprising the steps of:

(a) determining a surge line associated with the turbocompressor as a function of a quantity, $h_r^\alpha q_r^\beta$;

(b) determining an operating point of the turbocompressor as a function of the quantity $h_r^\alpha q_r^\beta$;

(c) comparing the turbocompressor's operating point to the surge line; and (d) modulating an end control element associated with the turbocompressor, based on the comparison, to protect the turbocompressor from surge.

13. The method of claim 12 wherein $\alpha$ and $\beta$ are real-valued exponents.

14. The method of claim 12 wherein the surge line is also determined as a function of $q_r$.

15. The method of claim 12 wherein the operating point is also determined as a function of $q_r$.

16. The method of claim 12 wherein the surge line is also determined as a function of $N_e$.

17. The method of claim 12 wherein the operating point is also determined as a function of $N_e$.

18. The method of claim 12 wherein the step of comparing the turbocompressor's operating point to the surge line comprises the steps of:

(a) defining a set point value a predetermined distance from the surge line; and (b) comparing the set point value to the operating point.

19. The method of claim 18 wherein the predetermined distance is variable during operation.

20. The method of claim 18 wherein the step of defining a set point value comprises the steps of:

(a) plotting the surge line as a function of $h_r^\alpha q_r^\beta$ versus $q_r^2$;

(b) defining a set point reference line at a particular value of $h_r^\alpha q_r^\beta$; and (c) selecting the set point on the set point reference line.

21. The method of claim 12 wherein the step of determining an operating point as a function of the quantity $h_r^\alpha q_r^\beta$ comprises the steps of:

(a) detecting a differential pressure, $\Delta p_o$, produced by a differential pressure flow measurement device, and generating a differential pressure signal proportional to the differential pressure flow measurement;

(b) detecting a suction pressure, $p_s$, produced by a pressure measurement device in a suction of the turbocompressor, and generating a suction pressure signal proportional to the suction pressure;

(c) detecting a discharge pressure, $p_d$, produced by a pressure measurement device in a discharge of the turbocompressor, and generating a discharge pressure signal proportional to the discharge pressure;

(d) detecting a suction temperature, $T_s$, produced by a temperature measurement device in a suction of the turbocompressor, and generating a suction temperature signal proportional to the suction temperature;

(e) detecting a discharge temperature, $T_d$, produced by a temperature measurement device in a discharge of the turbocompressor, and generating a discharge temperature signal proportional to the discharge temperature;

(f) calculating a pressure ratio, $R_c$, by dividing the discharge pressure signal by the suction pressure signal;

(g) calculating a temperature ratio, $R_T$, by dividing the discharge temperature signal by the suction temperature signal;

(h) calculating an exponent, $\sigma$, by dividing a logarithm of the temperature ratio by a logarithm of the pressure ratio;

(i) calculating a reduced head, $h_r$, by taking the pressure ratio to the power of the exponent, reducing by unity, and dividing by the exponent;

(j) calculating a reduced head parameter, $h_r^\alpha$, by taking the reduced head to the a power;

(k) calculating a reduced flow parameter, $q_r^\beta$, by dividing the differential pressure signal by one of the suction pressure or discharge pressure signals, and taking the quotient to the $\beta/2$ power; and (l) calculating a product by multiplying the reduced head parameter by the reduced flow parameter.

22. The method of claim 12 wherein the step of determining a surge line as a function of a quantity, $h_r^\alpha q_r^\beta$ comprises the steps of:

(a) detecting a differential pressure, $\Delta p_o$, produced by a differential pressure flow measurement device, and generating a differential pressure signal proportional to the differential pressure flow measurement;

(b) detecting a suction pressure, $p_s$, produced by a pressure measurement device in a suction of the turbocompressor, and generating a suction pressure signal proportional to the suction pressure;

(c) detecting a discharge pressure, $p_d$, produced by a pressure measurement device in a discharge of the turbocompressor, and generating a discharge pressure signal proportional to the discharge pressure;

(d) detecting a suction temperature, $T_s$, produced by a temperature measurement device in a suction of the turbocompressor, and generating a suction temperature signal proportional to the suction temperature;

(e) detecting a discharge temperature, $T_d$, produced by a temperature measurement device in a discharge of the turbocompressor, and generating a discharge temperature signal proportional to the discharge temperature;

(f) calculating a pressure ratio, $R_c$, by dividing the discharge pressure signal by the suction pressure signal;

(g) calculating a temperature ratio, $R_T$, by dividing the discharge temperature signal by the suction temperature signal;

(h) calculating an exponent, $\sigma$, by dividing a logarithm of the temperature ratio by a logarithm of the pressure ratio;

(i) calculating a reduced head, $h_r$, by taking the pressure ratio to the power of the exponent, reducing by unity, and dividing by the exponent;

(j) calculating a reduced head parameter, $h_r^{\alpha}$, by taking the reduced head to the $\alpha$ power;

(k) calculating a reduced flow parameter, $q_r^{\beta}$, by dividing the differential pressure signal by one of the suction pressure or discharge pressure signals, and taking the quotient to the $\beta/2$ power;

(l) calculating a product by multiplying the reduced head parameter by the reduced flow parameter; and (m) evaluating a function of the product $f(h_r^{\alpha}q_r^{\beta})$.

23. An apparatus for protecting a turbocompressor from surge, the apparatus comprising:

(a) means for determining a surge line associated with the turbocompressor as a function of a quantity, $R_c^m q_r^n$;

(b) means for determining an operating point of the turbocompressor as a function of the quantity $R_c^m q_r^n$;

(c) means for comparing the turbocompressor's operating point to the surge line; and (d) means for modulating an end control element associated with the turbocompressor, based on the comparison, to protect the turbocompressor from surge.

24. The apparatus of claim 23 wherein m and n are real-valued exponents.

25. The apparatus of claim 23 wherein the surge line is also determined as a function of $q_r$.

26. The apparatus of claim 23 wherein the operating paint is also determined as a function of $q_r$.

27. The apparatus of claim 23 wherein the surge line is also determined as a function of $N_r$.

28. The apparatus of claim 23 wherein the operating paint is also determined as a function of $R_e$.

29. The apparatus of claim 23 wherein the means for comparing the turbocompressor's operating point to the surge line comprises:

(a) means for defining a set point value a predetermined distance from the surge line; and (b) means for comparing the set point value to the operating point.

30. The apparatus of claim 29 wherein the predetermined distance is variable during operation.

31. The apparatus of claim 29 wherein the means for defining a set point comprises:

(a) means for plotting the surge line as a function of $R_c^m q_r^n$ versus $q_r^2$;

(b) means for defining a set point reference line at a particular value of $R_c^m q_r^n$; and (c) means for selecting the set point on the set point reference line.

32. The apparatus of claim 23 wherein the means for determining an operating point as a function of the quantity $R_c^m q_r^n$ comprises:

(a) means for detecting a differential pressure, $\Delta p_o$, produced by a differential pressure flow measurement device, and generating a differential pressure signal proportional to the differential pressure flow measurement;

(b) means for detecting a suction pressure, $p_s$, produced by a pressure measurement device in a suction of the turbocompressor, and generating a suction pressure signal proportional to the suction pressure;

(c) means for detecting a discharge pressure, $p_d$, produced by a pressure measurement device in a discharge of the turbocompressor, and generating a discharge pressure signal proportional to the discharge pressure;

(d) means for calculating a pressure ratio parameter, $R_c^m$, by dividing the discharge pressure signal by the suction pressure signal, and taking the quotient to the m power;

(e) means for calculating a reduced flow parameter, $q_r^n$, by dividing the differential pressure signal by one of the suction pressure or discharge pressure signals, and taking the quotient to the n/2 power; and (f) means for calculating a product by multiplying the pressure ratio parameter by the reduced flow parameter.

33. The apparatus of claim 23 wherein the means for determining a surge line as a function of a quantity, $R_c^m q_r^n$, comprises:

(a) means for detecting a differential pressure, $\Delta p_o$, produced by a differential pressure flow measurement device, and generating a differential pressure signal proportional to the differential pressure flow measurement;

(b) means for detecting a suction pressure, $p_s$, produced by a pressure measurement device in a suction of the turbocompressor, and generating a suction pressure signal proportional to the suction pressure;

(c) means for detecting a discharge pressure, $p_d$, produced by a pressure measurement device in a discharge of the turbocompressor, and generating a discharge pressure signal proportional to the discharge pressure;

(d) means for calculating a pressure ratio parameter, $R_c^m$, by dividing the discharge pressure signal by the suction pressure signal, and taking the quotient to the m power;

(e) means for calculating a reduced flow parameter, $q_r^n$, by dividing the differential pressure signal by one of the suction pressure or discharge pressure signals, and taking the quotient to the n/2 power;

(f) means for calculating a product by multiplying the pressure ratio parameter by the reduced flow parameter; and (g) means for evaluating a function of the product $f(R_c^m q_r^n)$.

34. An apparatus for protecting a turbocompressor from surge, the apparatus comprising:

(a) means for determining a surge line associated with the turbocompressor as a function of a quantity, $h_r^{\alpha}q_r^{\beta}$;

(b) means for determining an operating point of the turbocompressor as a function of the quantity $h_r^{\alpha}q_r^{\beta}$;

(c) means for comparing the turbocompressor's operating point to the surge line; and (d) means for modulating an end control element associated with the turbocompressor, based on the comparison, to protect the turbocompressor from surge.

35. The apparatus of claim 34 wherein $\alpha$ and $\beta$ are real-valued exponents.

36. The apparatus of claim 34 wherein the surge line is also determined as a function of $q_r$.

37. The apparatus of claim 34 wherein the operating point is also determined as a function of $q_r$.

38. The apparatus of claim 34 wherein the surge line is also determined as a function of $N_e$.

39. The apparatus of claim 34 wherein the operating point is also determined as a function of $N_e$.

40. The apparatus of claim 34 wherein the means for comparing the turbocompressor's operating point to the surge line comprises:

(a) means for defining a set point value a predetermined distance from the surge line; and (b) means for comparing the set point value to the operating point.

41. The apparatus of claim 40 wherein the predetermined distance is variable during operation.

42. The apparatus of claim 40 wherein the means for defining a set point value comprises:

(a) means for plotting the surge line as a function of $h_r^{\alpha}q_r^{\beta}$ versus $q_r^2$;

(b) means for defining a set point reference line at a particular value of $h_r^{\alpha}q_r^{\beta}$; and (c) means for selecting the set point on the set point reference line.

43. The apparatus of claim 34 wherein the means for determining an operating point as a function of the quantity $h_r^{\alpha}q_r^{\beta}$ comprises:

(a) means for detecting a differential pressure, $\Delta p_o$, produced by a differential pressure flow measurement device, and generating a differential pressure signal proportional to the differential pressure flow measurement;

(b) means for detecting a suction pressure, $p_s$, produced by a pressure measurement device in a suction of the turbocompressor, and generating a suction pressure signal proportional to the suction pressure;

(c) means for detecting a discharge pressure, $p_d$, produced by a pressure measurement device in a discharge of the turbocompressor, and generating a discharge pressure signal proportional to the discharge pressure;

(d) means for detecting a suction temperature, $T_s$, produced by a temperature measurement device in a suction of the turbocompressor, and generating a suction temperature signal proportional to the suction temperature;

(e) means for detecting a discharge temperature, $T_d$, produced by a temperature measurement device in a discharge of the turbocompressor, and generating a discharge temperature signal proportional to the discharge temperature;

(f) means for calculating a pressure ratio, $R_c$, by dividing the discharge pressure signal by the suction pressure signal;

(g) means for calculating a temperature ratio, $R_T$, by dividing the discharge temperature signal by the suction temperature signal;

(h) means for calculating an exponent, $\sigma$, by dividing a logarithm of the temperature ratio by a logarithm of the pressure ratio;

(i) means for calculating a reduced head, $h_r$, by taking the pressure ratio to the power of the exponent, reducing by unity, and dividing by the exponent;

(j) means for calculating a reduced head parameter, $h_r^{\alpha}$, by taking the reduced head to the $\alpha$ power;

(k) means for calculating a reduced flow parameter, $q_r^{\beta}$, by dividing the differential pressure signal by one of the suction pressure or discharge pressure signals, and taking the quotient to the $\beta/2$ power; and (l) means for calculating a product by multiplying the reduced head parameter by the reduced flow parameter.

44. The apparatus of claim 34 wherein the means for determining a surge line as a function of a quantity, $h_r^{\alpha}q_r^{\beta}$, comprises:

(a) means for detecting a differential pressure, $\Delta p_o$, produced by a differential pressure flow measurement device, and generating a differential pressure signal proportional to the differential pressure flow measurement;

(b) means for detecting a suction pressure, $p_s$, produced by a pressure measurement device in a suction of the turbocompressor, and generating a suction pressure signal proportional to the suction pressure;

(c) means for detecting a discharge pressure, $p_d$, produced by a pressure measurement device in a discharge of the turbocompressor, and generating a discharge pressure signal proportional to the discharge pressure;

(d) means for detecting a suction temperature, $T_s$, produced by a temperature measurement device in a suction of the turbocompressor, and generating a suction temperature signal proportional to the suction temperature;

(e) means for detecting a discharge temperature, $T_d$, produced by a temperature measurement device in a discharge of the turbocompressor, and generating a discharge temperature signal proportional to the discharge temperature;

(f) means for calculating a pressure ratio, $R_c$, by dividing the discharge pressure signal by the suction pressure signal;

(g) means for calculating a temperature ratio, $R_T$, by dividing the discharge temperature signal by the suction temperature signal;

(h) means for calculating an exponent, $\sigma$, by dividing a logarithm of the temperature ratio by a logarithm of the pressure ratio;

(i) means for calculating a reduced head, $h_r$, by taking the pressure ratio to the power of the exponent, reducing by unity, and dividing by the exponent;

(j) means for calculating a reduced head parameter, $h_r^{\alpha}$, by taking the reduced head to the $\alpha$ power;

(k) means for calculating a reduced flow parameter, $q_r^{\beta}$, by dividing the differential pressure signal by one of the suction pressure or discharge pressure signals, and taking the quotient to the $\beta/2$ power;

(l) means for calculating a product by multiplying the reduced head parameter by the reduced flow parameter; and (m) means for evaluating a function of the product $f(h_r^{\alpha}q_r^{\beta})$.

* * * * *

UNITED STATES PATENT AND TRADEMARK OFFICE

CERTIFICATE OF CORRECTION

PATENT NO : 5,908,462

DATED : June 1, 1999

INVENTOR(S) : Brett W. Batson

It is certified that error appears in the above-identified patent and that said Letters Patent is hereby corrected as shown below:

At column 4, line 30: at the end of the line "1" should be --11--.

Claim 21, step (j): in the last line "a power" should be --α power-- .

Claim 26: at the end of the first line, "paint" should be --point--.

Claim 28: at the end of the first line, "paint" should be --point--.

Signed and Sealed this

Twenty-first Day of December, 1999

*Attest:*

Q. TODD DICKINSON

*Attesting Officer*

*Acting Commissioner of Patents and Trademarks*